US009267095B2

(12) United States Patent
Delaney et al.

(10) Patent No.: US 9,267,095 B2
(45) Date of Patent: Feb. 23, 2016

(54) LOW PH DETERGENT COMPOSITION COMPRISING NONIONIC SURFACTANTS

(71) Applicant: The Procter & Gamble Company, Cincinnati, OH (US)

(72) Inventors: Sarah Ann Delaney, Hebron, KY (US); Eugene Steven Sadlowski, Cincinnati, OH (US); Cheyne Thomas, Independence, KY (US); Peggy Marion Teyssier, Milford, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/284,418

(22) Filed: May 22, 2014

(65) Prior Publication Data

US 2014/0349908 A1 Nov. 27, 2014

Related U.S. Application Data

(60) Provisional application No. 61/827,138, filed on May 24, 2013.

(51) Int. Cl.

| | |
|---|---|
| ***C11D 1/02*** | (2006.01) |
| ***C11D 1/72*** | (2006.01) |
| ***C11D 1/83*** | (2006.01) |
| ***C11D 3/43*** | (2006.01) |
| ***C11D 7/50*** | (2006.01) |
| ***B08B 3/04*** | (2006.01) |
| ***C11D 1/825*** | (2006.01) |
| ***C11D 3/20*** | (2006.01) |

(52) U.S. Cl.

CPC ..... *C11D 1/825* (2013.01); *C11D 1/8305* (2013.01); *C11D 3/2075* (2013.01); *C11D 1/72* (2013.01)

(58) Field of Classification Search

CPC ..... C11D 1/02; C11D 1/72; C11D 1/83; C11D 3/2075; C11D 3/43; C11D 7/50; B08B 3/04

See application file for complete search history.

(56) References Cited

U.S. PATENT DOCUMENTS

| | | | |
|---|---|---|---|
| 2,493,445 | A | 1/1950 | Randolph et al. |
| 3,600,318 | A | 8/1971 | Mast |
| 3,650,968 | A | 3/1972 | Hodge et al. |
| 4,242,215 | A | 12/1980 | Aalbers et al. |
| 4,285,841 | A | 8/1981 | Barrat et al. |
| 4,486,195 | A | 12/1984 | Lillis et al. |
| 4,529,525 | A | 7/1985 | Dormal et al. |
| 4,737,314 | A | 4/1988 | Yokoyama et al. |
| 5,057,246 | A | 10/1991 | Bertho et al. |
| 5,466,851 | A | 11/1995 | Adams et al. |
| 5,484,555 | A | 1/1996 | Schepers |
| 5,536,438 | A | 7/1996 | Scialla et al. |
| 5,559,090 | A | 9/1996 | Scialla et al. |
| 5,565,145 | A | 10/1996 | Watson et al. |
| 5,641,739 | A | 6/1997 | Kott et al. |
| 5,759,989 | A | 6/1998 | Bianchetti et al. |
| 5,858,948 | A | 1/1999 | Ghosh et al. |
| 5,972,869 | A | 10/1999 | Cao et al. |
| 6,037,317 | A | 3/2000 | Rapisarda et al. |
| 6,054,424 | A | 4/2000 | Ip |
| 6,060,443 | A | 5/2000 | Cripe et al. |
| 6,066,610 | A | 5/2000 | Sramek |
| 6,159,925 | A | 12/2000 | Blandiaux |
| 6,183,757 | B1 | 2/2001 | Beerse et al. |
| 6,239,092 | B1 | 5/2001 | Papasso et al. |
| 6,251,844 | B1 | 6/2001 | Leonard et al. |
| 6,262,007 | B1 | 7/2001 | Scialla et al. |
| 6,303,556 | B1 | 10/2001 | Kott et al. |
| 6,313,085 | B1 | 11/2001 | Le Hen-Ferrenbach |
| 6,376,449 | B2 | 4/2002 | Olsen |
| 6,451,064 | B1 | 9/2002 | Del Duca et al. |
| 6,521,577 | B1 | 2/2003 | Ofosu-Asante et al. |
| 6,525,012 | B2 | 2/2003 | Price et al. |
| 6,627,590 | B1 | 9/2003 | Sherry et al. |
| 6,630,435 | B1 | 10/2003 | Gagliardini et al. |
| 6,740,630 | B2 | 5/2004 | Aouad et al. |
| 6,797,685 | B2 | 9/2004 | Zhu et al. |
| 7,148,187 | B1 | 12/2006 | Simon et al. |
| 7,820,610 | B2 | 10/2010 | Showell et al. |
| 8,026,203 | B2 | 9/2011 | Courchay et al. |
| 8,097,579 | B2 | 1/2012 | Danzinger et al. |
| 8,729,007 | B2 | 5/2014 | Sadlowski et al. |
| 2002/0107167 | A1 | 8/2002 | Aizawa et al. |
| 2003/0185783 | A1 | 10/2003 | Terazaki |

(Continued)

FOREIGN PATENT DOCUMENTS

| | | | |
|---|---|---|---|
| DE | 19822688 | A1 | 11/1999 |
| DE | 100 32 588 | A1 | 1/2002 |

(Continued)

OTHER PUBLICATIONS

J. Chem. Soc., Faraday Trans. I, 1983, 79, 953-964; "Kinetics of the Acid-catalysed Hydrolysis of Dodecylsulphate and Dodecyldiethoxysulphate Surfactants in Concentrated Micellar Solutions"; Christopher J. Garnet.

J. Chem. Soc., Perkin Trans. 2, 2001, 1489-1495; "The hydrolysis of C12 primary alkyl sulfates in concentratedaqueous solutions. Part 1. General features, kinetic form and mode of catalysis in sodium dodecyl sulfate hydrolysis" ; Donald Bethell.

PCT Search Report Dated Sep. 18, 2014; PCT/US2014/039104; 12 Pages.

*Primary Examiner* — Brian P Mruk

(74) *Attorney, Agent, or Firm* — Gregory S. Darley-Emerson; Leonard W. Lewis; Steven W. Miller

(57) ABSTRACT

Detergent compositions and, more specifically, low pH detergent compositions comprising nonionic surfactants that are suitable for washing of clothes, and methods of making and using the same.

16 Claims, No Drawings

(56) References Cited

U.S. PATENT DOCUMENTS

| | | | |
|---|---|---|---|
| 2004/0092413 | A1 | 5/2004 | Ticktin |
| 2004/0092422 | A1 | 5/2004 | Carr et al. |
| 2006/0040837 | A1 | 2/2006 | Frantz et al. |
| 2006/0111261 | A1 | 5/2006 | Sadlowski et al. |
| 2006/0251605 | A1 | 11/2006 | Belmar et al. |
| 2008/0015135 | A1 | 1/2008 | De Buzzaccarini et al. |
| 2008/0139434 | A1 | 6/2008 | Basappa et al. |
| 2008/0248988 | A1 | 10/2008 | Gambogi et al. |
| 2009/0215854 | A1 | 8/2009 | Pan et al. |
| 2009/0312227 | A1 | 12/2009 | Murphy et al. |
| 2010/0093595 | A1 | 4/2010 | Holzhauer et al. |
| 2010/0303739 | A1 | 12/2010 | Spoerer et al. |
| 2011/0061174 | A1 | 3/2011 | Boutique et al. |
| 2011/0075466 | A1 | 3/2011 | Thorp et al. |
| 2011/0146707 | A1 | 6/2011 | Cermenati et al. |
| 2011/0146725 | A1 | 6/2011 | Woo et al. |
| 2013/0061402 | A1 | 3/2013 | Frankenbach et al. |
| 2013/0184195 | A1 | 7/2013 | Sadlowski et al. |
| 2013/0267451 | A1 | 10/2013 | Hardy et al. |
| 2013/0281344 | A1 | 10/2013 | Tarng et al. |
| 2013/0305461 | A1 | 11/2013 | Ceccobelli et al. |
| 2014/0026331 | A1 | 1/2014 | Boeh et al. |

FOREIGN PATENT DOCUMENTS

| | | | | | |
|---|---|---|---|---|---|
| EP | 0019315 | A1 | | 11/1980 | |
| EP | 0518401 | A1 | | 12/1992 | |
| EP | 0619366 | A1 | | 10/1994 | |
| EP | 0666308 | A2 | | 8/1995 | |
| EP | 0781 836 | A1 | | 7/1997 | |
| EP | 0839903 | A1 | | 5/1998 | |
| EP | 908511 | | * | 4/1999 | ..... C11D 3/00 |
| EP | 0908511 | A1 | | 4/1999 | |
| EP | 1696023 | A1 | | 8/2006 | |
| EP | 2522714 | A1 | | 11/2012 | |
| GB | 1489694 | A | | 10/1977 | |
| GB | 2205578 | A | | 12/1988 | |
| JP | 2000192092 | A | | 7/2000 | |
| JP | 2002053894 | A | | 2/2002 | |
| JP | 2007308592 | A | | 11/2007 | |
| JP | 2012092163 | A | | 5/2012 | |
| WO | WO 91/16409 | A1 | | 10/1991 | |
| WO | WO 94/01520 | A1 | | 1/1994 | |
| WO | WO 98/27189 | A1 | | 6/1998 | |
| WO | WO 99/09944 | A1 | | 3/1999 | |
| WO | WO 99/10457 | A1 | | 3/1999 | |
| WO | WO 00/71667 | A1 | | 11/2000 | |
| WO | WO 01/05874 | A1 | | 1/2001 | |
| WO | WO 02/50225 | A1 | | 6/2002 | |
| WO | WO 01/00758 | A2 | | 1/2004 | |
| WO | WO 2006/055788 | A1 | | 5/2006 | |
| WO | WO 2007/107191 | A1 | | 9/2007 | |
| WO | WO 2008/068222 | A1 | | 6/2008 | |
| WO | WO 2009/148914 | A1 | | 12/2009 | |
| WO | WO 2011/027721 | A1 | | 3/2011 | |
| WO | WO 2011/032138 | A2 | | 3/2011 | |
| WO | WO 2012/122232 | A1 | | 9/2012 | |
| WO | WO 2013/041832 | A1 | | 3/2013 | |
| WO | WO 2013/092049 | A1 | | 6/2013 | |
| WO | WO 2013/142486 | A1 | | 9/2013 | |
| WO | WO 2014/018309 | A1 | | 1/2014 | |

* cited by examiner

LOW PH DETERGENT COMPOSITION COMPRISING NONIONIC SURFACTANTS

The present application claims benefit of U.S. Provisional Application 61/827,138, filed on May 24, 2013.

FIELD OF THE INVENTION

The present disclosure relates generally to detergent compositions and, more specifically, to low pH detergent compositions comprising nonionic surfactants that are suitable for washing of clothes, and methods of making and using the same.

BACKGROUND OF THE INVENTION

Traditional detergents used in laundry are typically formulated at a high pH (i.e., above 7), because high pH enables the use of traditional builders and surfactants. However, it has been found that certain acidic detergents (i.e., with pH below 7) may provide benefits such as improved removal of residues from fabrics and associated improvement in whiteness, improved bleachable stain removal, and self-preservation benefits.

It is desirable to both the formulator and the consumer that such detergents have desirable viscosities. Compositions with viscosities that are too high may be difficult to process or to use; viscosities that are too low may indicate a lack of cleaning power or value to the consumer. In order to obtain desirable viscosities, many detergents, especially those that have high levels of water (e.g., above 60%), require the use of thickening agents. For example, a formulator may add salt, such as sodium chloride or sodium formate, to thicken compositions that have low viscosities.

However, such thickening agents can present difficulties. For example, certain thickening agents, such as salt, may have corrosive effects at low pH on metals commonly used in manufacturing plants, such as 316 stainless steel. Thickening agents may lead to stability challenges such as "salting out." There may be limits to the amount of viscosity that can be built with thickening agents. And, of course, the use of thickening agents adds extra cost to a composition.

Therefore, there is a need for an effective, low cost solution to thickening high water, low pH detergent compositions. It has been surprisingly discovered that blending high HLB and low HLB nonionic surfactants in high water, low pH detergent compositions can yield compositions with desirable viscosities without the use of thickening agents.

SUMMARY OF THE INVENTION

The present disclosure attempts to solve one or more of the needs by providing, in some aspects, a liquid laundry detergent composition comprising: from about 2% to about 20% by weight of the composition of a surfactant system, where the surfactant system comprises a first nonionic surfactant (A) where A has an HLB less than about 10, a second nonionic surfactant (B) where B has an HLB greater than about 10, where the weight ratio of A:B is from about 1:100 to about 40:100, and anionic surfactant; where the composition has a neat pH of from about 1.5 to about 6.9; and where the composition has a viscosity of from about 200 cps to about 3000 measured at 20 $s^{-1}$ at 21.1° C.

The present disclosure also provides a liquid laundry detergent composition comprising: from about 2% to about 20% by weight of the composition of a surfactant system, where the surfactant system comprises a first nonionic surfactant (A) where A has an HLB less than about 10, a second nonionic surfactant (B) where B has an HLB greater than about 10, where the weight ratio of A:B is from about 1:100 to about 40:100, and anionic surfactant; from about 5% to about 15% by weight of the composition of organic acid, where the organic acid comprises 6 carbon atoms or fewer; from about 60% to about 90% water; where the composition has a neat pH of from about 2 to about 4; and where the composition has a viscosity of from about 200 cps to about 1200 cps measured at 20 $s^{-1}$ at 21.1° C.

In other aspects, the present disclosure provides a method for treating a surface comprising the step of contacting the surface with the compositions described herein.

DETAILED DESCRIPTION OF THE INVENTION

As used herein, the articles "a" and "an" when used in a claim, are understood to mean one or more of what is claimed or described.

As used herein, the terms "include," "includes," and "including" are meant to be non-limiting.

The compositions of the present invention can comprise, consist essentially of, or consist of, the components of the present disclosure.

The terms "substantially free of" or "substantially free from" may be used herein. This means that the indicated material is at the very minimum not deliberately added to the composition to form part of it, or, preferably, is not present at analytically detectable levels. It is meant to include compositions whereby the indicated material is present only as an impurity in one of the other materials deliberately included.

Unless otherwise noted, all component or composition levels are in reference to the active portion of that component or composition, and are exclusive of impurities, for example, residual solvents or by-products, which may be present in commercially available sources of such components or compositions.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Liquid Laundry Composition

The compositions disclosed herein are low pH liquid laundry detergent compositions comprising nonionic surfactants. The compositions typically comprise a mixture of nonionic surfactants. It is believed that a mixture of high HLB (hydrophilic-lipophilic balance) nonionic surfactant and low HLB nonionic surfactant builds viscosity through the creation of micelles. Micelles are the structural arrangements resulting from hydrophobic tails of the surfactants arranging to avoid contact with water, thereby minimizing the area to volume ratio, and from hydrophilic head groups repelling from each other, thereby maximizing the area to volume ratio. In some aspects, it is believed that the nonionic mixtures of the present compositions lead to the creation of worm-like micelles, as evidenced by a drop in viscosity at high shear and by shear induced birefringence. Because viscosity is built through the selection of surfactants, in some aspects, the compositions described herein do not require the addition of thickening agents, such as salt.

The detergent compositions of the present invention may be in liquid, gel, or paste form. The compositions are typically liquids. In some aspects, the compositions comprise from about 50% to about 95%, or from about 60% to about 90%, or from about 65% to about 81%, by weight of the composition, water. The compositions may comprise at least 50%, or at least 60%, or at least 70%, or at least 75%, or at least 80%, or at least 85% water.

In some aspects, the composition is in a unit dose form, where the composition is encapsulated in a water-soluble film or pouch; the water-soluble film or pouch may comprise polyvinyl alcohol, polyvinyl acetate, or mixtures thereof. In some aspects, the unit dose form comprises at least two compartments, or at least three compartments. In some aspects, at least one compartment may be superimposed on another compartment.

The disclosed compositions may be isotropic at 22° C. As used herein, "isotropic" means a clear mixture having a % transmittance of greater than 50% at a wavelength of 570 nm measured via a standard 10 mm pathlength cuvette with a Beckman DU spectrophotometer, in the absence of dyes and/or opacifiers.

The components of the liquid cleaning compositions herein, as well as preparation and use, are described in greater detail as follows.

Surfactant System

The detergent compositions described herein comprise from about 2% to about 20%, or from about 9% to about 20%, or from about 5% to about 15%, or from about 7% to about 12% by weight of the detergent composition of a surfactant system.

The surfactant system may comprise a detersive surfactant selected from nonionic surfactants, anionic surfactants, amphoteric surfactants, zwitterionic surfactants, cationic surfactants, or mixtures thereof. In some aspects, the surfactant system comprises nonionic surfactant, anionic surfactant, or mixtures thereof. In some aspects, the surfactant system consists of a nonionic surfactant and an anionic surfactant, e.g., a blend of two nonionic surfactants and an anionic surfactant. The composition may be substantially free of zwitterionic surfactant. Those of ordinary skill in the art will understand that a detersive surfactant encompasses any surfactant or mixture of surfactants that provide cleaning, stain removing or other laundering benefit to fabrics during the laundering process.

Nonionic Surfactant

The surfactant system of the present compositions comprises a nonionic surfactant. The surfactant system may comprise a first nonionic surfactant (A) and a second nonionic surfactant (B). In some aspects, the surfactant system comprises no more than two nonionic surfactants. The weight ratio of the first nonionic surfactant to the second nonionic surfactant (A:B) may be from about 1:100 to about 40:100, or from about 10:100 to about 30:100, or from about 15:100 to about 25:100.

In some aspects, the detergent composition comprises from about 1% to about 12%, or from about 2% to about 10%, or from about 4% to about 8%, by weight of the detergent composition, of nonionic surfactant.

Suitable nonionic surfactants useful herein include any of the conventional nonionic surfactants typically used in detergent products. These include, for example, alkoxylated fatty alcohols and amine oxide surfactants. Generally, the nonionic surfactants used herein are liquids.

The nonionic surfactant may be an ethoxylated nonionic surfactant. These materials are described in U.S. Pat. No. 4,285,841, Barrat et al, issued Aug. 25, 1981. In one aspect, the nonionic surfactant is selected from the ethoxylated alcohols and ethoxylated alkyl phenols of the formula $R(OC_2H_4)_nOH$, where R is selected from the group consisting of aliphatic hydrocarbon radicals containing from about 8 to about 18 carbon atoms and alkyl phenyl radicals in which the alkyl groups contain from about 8 to about 12 carbon atoms, and the average value of n is from about 5 to about 15. These surfactants are more fully described in U.S. Pat. No. 4,284,532, Leikhim et al, issued Aug. 18, 1981. In one aspect, the nonionic surfactant is selected from ethoxylated alcohols (also known as fatty alcohol ethoxylates) having an average of from about 10 to about 16 carbon atoms in the alcohol and an average degree of ethoxylation of from about 1 to about 12 moles of ethylene oxide per mole of alcohol.

A shorthand method of naming a fatty alcohol ethoxylate refers to its number of carbons in the alkyl chain and its average number of ethoxylate (EO) groups. For example, a fatty alcohol ethoxylate with from twelve to fourteen carbon atoms in its alkyl chain and an average of nine ethoxylate groups can be written as "C12,14 EO9". This naming convention is used in this application.

In some aspects, the nonionic surfactant comprises C12-C18 alkyl ethoxylate. In some aspects, the C12-C18 alkyl ethoxylate is selected from the group consisting of: C12,14 EO9; C12,14 EO7; C12,15 EO3; and mixtures thereof. In some aspects, the C12-C18 alkyl ethoxylate is C12,14 EO7 and C12,15 EO3, and in some aspects, the molar ratio of C12,14 EO7 to C12,15 EO3 is about 2:1.

Another suitable type of nonionic surfactant useful herein is amine oxide. Amine oxides are materials which are often referred to in the art as "semi-polar" nonionics. Amine oxides may have the formula: $R(EO)_x(PO)_y(BO)_zN(O)(CH_2R')_2.qH_2O$. In this formula, R is a relatively long-chain hydrocarbyl moiety which can be saturated or unsaturated, linear or branched, and can contain from 8 to 20, in one embodiment from 10 to 16 carbon atoms, and is alternatively a $C_{12}$-$C_{16}$ primary alkyl. R' is a short-chain moiety, and may be selected from hydrogen, methyl and —$CH_2OH$. When x+y+z is different from 0, EO is ethyleneoxy, PO is propyleneoxy and BO is butyleneoxy. Amine oxide surfactants are non-limitingly illustrated by $C_{12-14}$ alkyldimethyl amine oxide. In some aspects, the surfactant system is substantially free of semi-polar nonionic surfactants, or of amine oxides.

Further non-limiting examples of nonionic surfactants useful herein include: a) $C_{12}$-$C_{18}$ alkyl ethoxylates, such as, NEODOL® nonionic surfactants from Shell; b) $C_6$-$C_{12}$ alkyl phenol alkoxylates where the alkoxylate units are a mixture of ethyleneoxy and propyleneoxy units; c) $C_{12}$-$C_{18}$ alcohol and $C_6$-$C_{12}$ alkyl phenol condensates with ethylene oxide/propylene oxide block polymers such as Pluronic® from BASF; d) Alkylpolysaccharides as discussed in U.S. Pat. No. 4,565,647 to Llenado, issued Jan. 26, 1986; specifically alkylpolyglycosides as discussed in U.S. Pat. No. 4,483,780 and U.S. Pat. No. 4,483,779; e) Polyhydroxy fatty acid amides as discussed in U.S. Pat. No. 5,332,528, WO 92/06162, WO 93/19146, WO 93/19038, and WO 94/09099; and f) ether capped poly (oxyalkylated) alcohol surfactants as discussed in U.S. Pat. No. 6,482,994 and WO 01/42408.

Nonionic surfactants can be classified by the balance between the hydrophilic and lipophilic moieties in the surfactant molecule. The hydrophile-lipophile balance (HLB) scale devised by Griffin in 1949 is a scale from 0-20 (20 being Hydrophilic) used to characterise the nature of surfactants. The HLB of a surfactant may be calculated as follows:

$$HLB=20*Mh/M$$

where Mh is the molecular mass of the hydrophilic portion of the molecule, and M is the molecular mass of the whole molecule, giving a result on a scale of 0 to 20. An HLB value of 0 corresponds to a completely lipophilic/hydrophobic molecule, and a value of 20 corresponds to a completely hydrophilic/lipophobic molecule. See Griffin, W. C. Calculation of HLB values of Nonionic Surfactants, J. Soc. Cosmet. Chem. 1954, 5, 249-256. The HLB values for commonly-used surfactants are readily available in the literature (e.g., HLB Index in McCutcheon's Emulsifiers and Detergents, MC Publishing Co., 2004). The HLB value for a mixture of surfactants can be calculated as a weighted average of the HLB values of the surfactants.

A typical nonionic alcohol ethoxylate surfactant has the following formula:

$$H_3C—(CH_2)_m—(O—CH_2—CH_2)_n—OH$$

The ($H_3C—(CH_2)_m$) portion of the formula is the hydrophobic portion, and the ($(O—CH_2—CH_2)_n—OH$) portion is the hydrophilic portion. The molar mass of the hydrophobic $CH_3—(CH_2)_m$ portion (Mp) is calculated using the equation 15+(m)*14 where m=average chain length-1. The molar mass of the hydrophilic portion (Mh) can be calculated by n*44+17, where n is the number of ethoxylate groups (EO).

Table 1 below shows a non-limiting list of exemplary nonionic surfactants and their corresponding HLB values. The HLB value is calculated using the equation referenced above. Commercially available nonionic surfactants typically consist of a distribution of alcohol chain lengths. In order to estimate the molar mass, an average chain length is used, unless otherwise specified in the material specifications.

TABLE 1

Exemplary nonionic surfactants and HLB values

| Surfactants | Average Chain Length (m) | # EO (n) | Hydrophobic portion (Mp) | Hydrophilic portion (Mh) | Total (M) | HLB |
|---|---|---|---|---|---|---|
| C16 EO7 | 16 | 7 | 225 | 325 | 550 | 11.82 |
| C12,13 EO2 | 12.5 | 2 | 176 | 105 | 281 | 7.47 |
| C12,13 EO3 | 12.5 | 3 | 176 | 149 | 325 | 9.17 |
| C12,14 EO7 | 13 | 7 | 183 | 325 | 508 | 12.80 |
| C12,14 EO9 | 13 | 9 | 183 | 413 | 596 | 13.86 |
| C14,15 EO7 | 14.5 | 7 | 204 | 325 | 529 | 12.29 |

A sample calculation for C12, 13 EO 3 (HLB=9.17), an alcohol ethoxylate comprising a hydrophobic portion with an average 12 to 13 carbons (average=12.5), and a hydrophilic portion with three ethoxylate groups, is shown below:

$$(Mp)=15+(12.5-1)*14=176$$

$$(Mh)=3*44+17=149$$

$$(M)=Mp+Mh=176+149=325$$

$$HLB=20*149/325=9.17$$

The alkoxylated fatty alcohol materials useful in the detergent compositions herein typically have HLB values that range from about 3 to about 17, or from about 6 to about 15, or from about 8 to about 15.

In some aspects, the first nonionic surfactant (A) has a HLB value less than about 10, or less than about 9.5, or less than about 9, or less than about 8.5, or less than about 8. In some aspects, the first nonionic surfactant (A) is a fatty alcohol ethoxylate selected from the group consisting of: C12,13 EO1; C12,13 EO1.5; C12,13 EO2; C12,13 EO3; and mixtures thereof. In some aspects, the first nonionic surfactant (A) is selected from the group consisting of: C12,13 EO2; C12,13 EO3; and mixtures thereof.

In some aspects, the second nonionic surfactant (B) has a HLB value greater than about 10, or greater than about 10.5, or greater than about 11, or greater than about 11.5, or greater than about 12. In some aspects, the second nonionic surfactant (B) is a fatty alcohol ethoxylate selected from the group consisting of: C9,11 EO5; C11,16 EO7; C12,13 EO5; C12,13 EO6.5; C12,13 EO8; C12,13 EO9; C12,14 EO7; C12,14 EO8; C12,14 EO9; C14,15 EO5; C14,15 EO7; C14,15 EO8; C11 EO9; C12,14 EO9; C12,15 EO7; C12,15 EO10; C14,15 EO8; C14,15 EO9; C14,18 EO9; C10 EO3; C10 EO6; C12 EO3; C12 EO6; C12 EO9; and mixtures thereof. In some aspects, the second nonionic surfactant (B) is selected from the group consisting of: C11,16 EO7; C14,15 EO7; C12,14 EO7; C12,14 EO9; and mixtures thereof.

In some aspects, the detergent composition has a ΔHLB, calculated as the difference between the HLB of the second nonionic surfactant (B) and the HLB of the first nonionic surfactant (A). In some aspects, the composition has a ΔHLB of at least about 1, or at least about 2, or at least about 3, or at least about 4, or at least about 5. In some aspects, the composition has a ΔHLB of from about 1 to about 10, or from about 1.5 to about 6, or from about 2 to about 5, or from about 2 to about 3.5.

In some aspects, the HLB of the mixture of the first and the second nonionic surfactants is from about 8 to about 10, or is about 9. In some aspects, the HLB of the surfactant system of the detergent composition is from about 8 to about 10, or is about 9.

Anionic Surfactant

The surfactant system typically comprises anionic surfactant. In some aspects, the composition comprises, by weight of the detergent composition, from about 1% to about 25%, or from about 2% to about 20%, or from about 5% to about 15%, of anionic surfactant.

Suitable anionic surfactants include any conventional anionic surfactant used in detergent products. These include, for example, the alkyl benzene sulfonic acids and their salts as well as alkoxylated or non-alkoxylated alkyl sulfate materials. The anionic surfactants may be present in acid form or in neutralized (e.g., salt) form. The anionic surfactants may be linear, branched, or a mixture thereof.

Exemplary anionic surfactants are the alkali metal salts of $C_{10}$-$C_{18}$ alkyl benzene sulfonic acids or $C_{11}$-$C_{14}$ alkyl benzene sulfonic acids. In some aspects, the alkyl group is linear, and such linear alkyl benzene sulfonates are known as "LAS." Alkyl benzene sulfonates, and particularly LAS, are well known in the art. Such surfactants and their preparation are described in, for example, U.S. Pat. Nos. 2,220,099 and 2,477,383. Especially useful are the sodium and potassium linear straight chain alkylbenzene sulfonates in which the average number of carbon atoms in the alkyl group is from about 11 to about 14. Sodium $C_{11}$-$C_{14}$, e.g., $C_{12}$, LAS is a specific example of such surfactants.

Another exemplary type of anionic surfactant is alkoxylated alkyl sulfate surfactants. Preferred are ethoxylated alkyl sulfate surfactants. Such materials are also known as alkyl ether sulfates, alkyl polyethoxylate sulfates, or simply "AES," and correspond to the formula: $R'—O—(C_2H_4O)_nSO_3M$, where R' is a $C_8$-$C_{20}$ alkyl group; n is from about 0.5 to about 20, or from about 1 to about 20; and M is a salt-forming cation. In one aspect, R' is a $C_{10}$-$C_{18}$ alkyl; n is from about 1 to about 15; and M is sodium, potassium, ammonium, alkylammonium, or alkanolammonium. In one aspect, R' is a $C_{12}$-$C_{16}$ alkyl; n is from about 0.5 to about 6, or from about 1 to about 6; and M is sodium.

Alkyl ether sulfates are generally available in the form of mixtures comprising varying R' chain lengths and varying degrees of ethoxylation. Frequently such mixtures also contain some non-ethoxylated alkyl sulfate ("AS") materials, i.e., surfactants of the above ethoxylated alkyl sulfate formula where n=0.

Non-ethoxylated alkyl sulfates may also be added separately to the compositions of the invention. Specific examples of non-alkoxylated alkyl ether sulfate surfactants are those produced by the sulfation of higher $C_8$-$C_{20}$ fatty alcohols. Conventional primary alkyl sulfate surfactants have the general formula: $ROSO_3$-$M^+$ where R is a linear $C_8$-$C_{20}$ hydrocarbyl group and M is a water-solubilizing cation. In one aspect, R is a $C_{10}$-$C_{15}$ alkyl and M is alkali metal, more specifically R is $C_{12}$-$C_{14}$ and M is sodium.

Branched Surfactants

The surfactants of the present compositions may be branched detersive surfactants. Suitable branched detersive surfactants include anionic branched surfactants selected from branched sulphate or branched sulphonate surfactants, e.g., branched alkyl sulphate, branched alkyl alkoxylated sulphate, and branched alkyl benzene sulphonates, comprising one or more random alkyl branches, e.g., $C_{1-4}$ alkyl groups, typically methyl and/or ethyl groups.

In some aspects, the branched detersive surfactant is a mid-chain branched detersive surfactant, typically, a mid-chain branched anionic detersive surfactant, for example, a mid-chain branched alkyl sulphate and/or a mid-chain branched alkyl benzene sulphonate. In some aspects, the detersive surfactant is a mid-chain branched alkyl sulphate. In some aspects, the mid-chain branches are $C_{1-4}$ alkyl groups, typically methyl and/or ethyl groups.

In some aspects, the branched surfactant comprises a longer alkyl chain, mid-chain branched surfactant compound of the formula:

$$A_b\text{-X—B}$$

where:

(a) $A_b$ is a hydrophobic C9 to C22 (total carbons in the moiety), typically from about C12 to about C18, mid-chain branched alkyl moiety having: (1) a longest linear carbon chain attached to the —X—B moiety in the range of from 8 to 21 carbon atoms; (2) one or more C1-C3 alkyl moieties branching from this longest linear carbon chain; (3) at least one of the branching alkyl moieties is attached directly to a carbon of the longest linear carbon chain at a position within the range of position 2 carbon (counting from carbon #1 which is attached to the —X—B moiety) to position ω−2 carbon (the terminal carbon minus 2 carbons, i.e., the third carbon from the end of the longest linear carbon chain); and (4) the surfactant composition has an average total number of carbon atoms in the $A_b$-X moiety in the above formula within the range of greater than 14.5 to about 17.5 (typically from about 15 to about 17);

b) B is a hydrophilic moiety selected from sulfates, sulfonates, amine oxides, polyoxyalkylene (such as polyoxyethylene and polyoxypropylene), alkoxylated sulfates, polyhydroxy moieties, phosphate esters, glycerol sulfonates, polygluconates, polyphosphate esters, phosphonates, sulfosuccinates, sulfosuccaminates, polyalkoxylated carboxylates, glucamides, taurinates, sarcosinates, glycinates, isethionates, dialkanolamides, monoalkanolamides, monoalkanolamide sulfates, diglycolamides, diglycolamide sulfates, glycerol esters, glycerol ester sulfates, glycerol ethers, glycerol ether sulfates, polyglycerol ethers, polyglycerol ether sulfates, sorbitan esters, polyalkoxylated sorbitan esters, ammonioalkanesulfonates, amidopropyl betaines, alkylated quats, alkylated/polyhydroxyalkylated quats, alkylated/polyhydroxylated oxypropyl quats, imidazolines, 2-ylsuccinates, sulfonated alkyl esters, and sulfonated fatty acids (it is to be noted that more than one hydrophobic moiety may be attached to B, for example as in $(A_b\text{-X})_z$—B to give dimethyl quats); and (c) X is selected from —CH2- and —C(O)—.

Generally, in the above formula the $A_b$ moiety does not have any quaternary substituted carbon atoms (i.e., 4 carbon atoms directly attached to one carbon atom). Depending on which hydrophilic moiety (B) is selected, the resultant surfactant may be anionic, nonionic, cationic, zwitterionic, amphoteric, or ampholytic. In some aspects, B is sulfate and the resultant surfactant is anionic.

In some aspects, the branched surfactant comprises a longer alkyl chain, mid-chain branched surfactant compound of the above formula wherein the $A_b$ moiety is a branched primary alkyl moiety having the formula:

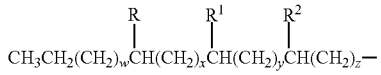

wherein the total number of carbon atoms in the branched primary alkyl moiety of this formula (Including the R, $R^1$, and $R^2$ branching) is from 13 to 19; R, R1, and R2 are each independently selected from hydrogen and C1-C3 alkyl (typically methyl), provided R, R1, and R2 are not all hydrogen and, when z is 0, at least R or R1 is not hydrogen; w is an integer from 0 to 13; x is an integer from 0 to 13; y is an integer from 0 to 13; z is an integer from 0 to 13; and w+x+y+z is from 7 to 13.

In certain aspects, the branched surfactant comprises a longer alkyl chain, mid-chain branched surfactant compound of the above formula wherein the $A_b$ moiety is a branched primary alkyl moiety having the formula selected from:

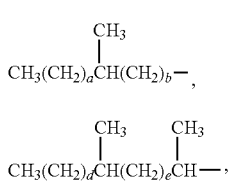

(I)

(II)

or mixtures thereof; wherein a, b, d, and e are integers, a+b is from 10 to 16, d+e is from 8 to 14 and wherein further when a+b=10, a is an integer from 2 to 9 and b is an integer from 1 to 8;

when a+b=11, a is an integer from 2 to 10 and b is an integer from 1 to 9;

when a+b=12, a is an integer from 2 to 11 and b is an integer from 1 to 10;

when a+b=13, a is an integer from 2 to 12 and b is an integer from 1 to 11;

when a+b=14, a is an integer from 2 to 13 and b is an integer from 1 to 12;

when a+b=15, a is an integer from 2 to 14 and b is an integer from 1 to 13;

when a+b=16, a is an integer from 2 to 15 and b is an integer from 1 to 14;

when d+e=8, d is an integer from 2 to 7 and e is an integer from 1 to 6;

when d+e=9, d is an integer from 2 to 8 and e is an integer from 1 to 7;

when d+e=10, d is an integer from 2 to 9 and e is an integer from 1 to 8;

when d+e=11, d is an integer from 2 to 10 and e is an integer from 1 to 9;

when d+e=12, d is an integer from 2 to 11 and e is an integer from 1 to 10;

when d+e=13, d is an integer from 2 to 12 and e is an integer from 1 to 11;

when d+e=14, d is an integer from 2 to 13 and e is an integer from 1 to 12.

In the mid-chain branched surfactant compounds described above, certain points of branching (e.g., the location along the chain of the R, $R^1$, and/or $R^2$ moieties in the above formula) are preferred over other points of branching along the backbone of the surfactant. The formula below illustrates the mid-chain branching range (i.e., where points of branching occur), preferred mid-chain branching range, and more preferred mid-chain branching range for mono-methyl branched alkyl $A^b$ moieties.

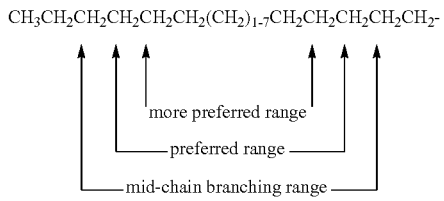

For mono-methyl substituted surfactants, these ranges exclude the two terminal carbon atoms of the chain and the carbon atom immediately adjacent to the —X—B group.

The formula below illustrates the mid-chain branching range, preferred mid-chain branching range, and more preferred mid-chain branching range for di-methyl substituted alkyl $A^b$ moieties.

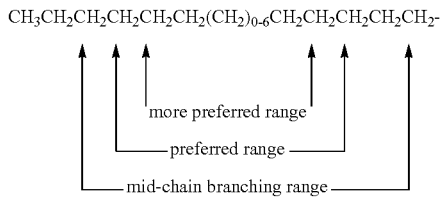

Additional suitable branched surfactants are disclosed in U.S. Pat. No. 6,008,181, U.S. Pat. No. 6,060,443, U.S. Pat. No. 6,020,303, U.S. Pat. No. 6,153,577, U.S. Pat. No. 6,093,856, U.S. Pat. No. 6,015,781, U.S. Pat. No. 6,133,222, U.S. Pat. No. 6,326,348, U.S. Pat. No. 6,482,789, U.S. Pat. No. 6,677,289, U.S. Pat. No. 6,903,059, U.S. Pat. No. 6,660,711, U.S. Pat. No. 6,335,312, and WO 9918929. Yet other suitable branched surfactants include those described in WO9738956, WO9738957, and WO0102451.

In some aspects, the branched anionic surfactant comprises a branched modified alkylbenzene sulfonate (MLAS), as discussed in WO 99/05243, WO 99/05242, WO 99/05244, WO 99/05082, WO 99/05084, WO 99/05241, WO 99/07656, WO 00/23549, and WO 00/23548.

In some aspects, the branched anionic surfactant comprises a C12/13 alcohol-based surfactant comprising a methyl branch randomly distributed along the hydrophobe chain, e.g., Safol®, Marlipal® available from Sasol.

Further suitable branched anionic detersive surfactants include surfactants derived from alcohols branched in the 2-alkyl position, such as those sold under the trade names Isalchem®123, Isalchem®125, Isalchem®145, Isalchem®167, which are derived from the oxo process. Due to the oxo process, the branching is situated in the 2-alkyl position. These 2-alkyl branched alcohols are typically in the range of C11 to C14/C15 in length and comprise structural isomers that are all branched in the 2-alkyl position. These branched alcohols and surfactants are described in US20110033413.

Other suitable branched surfactants include those disclosed in U.S. Pat. No. 6,037,313 (P&G), WO9521233 (P&G), U.S. Pat. No. 3,480,556 (Atlantic Richfield), U.S. Pat. No. 6,683,224 (Cognis), US20030225304A1 (Kao), US2004236158A1 (R&H), U.S. Pat. No. 6,818,700 (Atofina), US2004154640 (Smith et al), EP1280746 (Shell), EP1025839 (L'Oreal), U.S. Pat. No. 6,765,119 (BASF), EP108084 (Dow), U.S. Pat. No. 6,723,867 (Cognis), EP1401792A1 (Shell), EP1401797A2 (Degussa AG), US2004048766 (Raths et al), U.S. Pat. No. 6,596,675 (L'Oreal), EP1136471 (Kao), EP961765 (Albemarle), U.S. Pat. No. 6,580,009 (BASF), US2003105352 (Dado et al), U.S. Pat. No. 6,573,345 (Cryovac), DE10155520 (BASF), U.S. Pat. No. 6,534,691 (du Pont), U.S. Pat. No. 6,407,279 (ExxonMobil), U.S. Pat. No. 5,831,134 (Peroxid-Chemie), U.S. Pat. No. 5,811,617 (Amoco), U.S. Pat. No. 5,463,143 (Shell), U.S. Pat. No. 5,304,675 (Mobil), U.S. Pat. No. 5,227,544 (BASF), U.S. Pat. No. 5,446,213A (MITSUBISHI KASEI CORPORATION), EP1230200A2 (BASF), EP1159237B1 (BASF), US20040006250A1 (NONE), EP1230200B1 (BASF), WO2004014826A1 (SHELL), U.S. Pat. No. 6,703,535B2 (CHEVRON), EP1140741B1 (BASF), WO2003095402A1 (OXENO), U.S. Pat. No. 6,765,106B2 (SHELL), US20040167355A1 (NONE), U.S. Pat. No. 6,700,027B1 (CHEVRON), US20040242946A1 (NONE), WO2005037751A2 (SHELL), WO2005037752A1 (SHELL), U.S. Pat. No. 6,906,230B1 (BASF), WO2005037747A2 (SHELL) OIL COMPANY.

Additional suitable branched anionic detersive surfactants include surfactant derivatives of isoprenoid-based polybranched detergent alcohols, as described in US 2010/0137649. Isoprenoid-based surfactants and isoprenoid derivatives are also described in the book entitled "Comprehensive Natural Products Chemistry: Isoprenoids Including Carotenoids and Steroids (Vol. two)", Barton and Nakanishi, © 1999, Elsevier Science Ltd and are included in the structure E, and are hereby incorporated by reference.

Further suitable branched anionic detersive surfactants include those derived from anteiso- and iso-alcohols. Such surfactants are disclosed in WO2012009525.

Additional suitable branched anionic detersive surfactants include those described in US Patent Application Nos. 2011/0171155A1 and 2011/0166370A1.

Suitable branched anionic surfactants also include Guerbet-alcohol-based surfactants. Guerbet alcohols are branched, primary monofunctional alcohols that have two linear carbon chains with the branch point always at the second carbon position. Guerbet alcohols are chemically described as 2-alkyl-1-alkanols. Guerbet alcohols generally have from 12 carbon atoms to 36 carbon atoms. The Guerbet alcohols may be represented by the following formula: (R1)(R2)$CHCH_2OH$, where R1 is a linear alkyl group, R2 is a linear alkyl group, the sum of the carbon atoms in R1 and R2 is 10 to 34, and both R1 and R2 are present. Guerbet alcohols are commercially available from Sasol as Isofol® alcohols and from Cognis as Guerbetol.

The surfactant system disclosed herein may comprise any of the branched surfactants described above individually or the surfactant system may comprise a mixture of the branched surfactants described above. Furthermore, each of the branched surfactants described above may include a bio-based content. In some aspects, the branched surfactant has a bio-based content of at least about 50%, at least about 60%, at least about 70%, at least about 80%, at least about 90%, at least about 95%, at least about 97%, or about 100%.

Anionic/Nonionic Combinations

The surfactant system may comprise a mixture of anionic surfactant and nonionic surfactant, e.g., linear alkyl benzene sulfonic acid and C12-18 alkyl ethoxylate. In some aspects, the weight ratio of anionic surfactant to nonionic surfactant is from about 1:100 to about 5:1, or from about 1:100 to about 3:1, or from about 1:100 to about 1:1, or from about 40:100 to about 75:100.

Organic Acid

The detergent compositions of the present invention may comprise an organic acid. The organic acid may be in the form of an organic carboxylic acid or polycarboxylic acid. Examples of organic acids that may be used include: acetic acid, adipic acid, aspartic acid, carboxymethyloxymalonic acid, carboxymethyloxysuccinic acid, citric acid, formic acid, glutaric acid, hydroxyethyliminodiacetic acid, iminodiacetic acid, lactic acid, maleic acid, malic acid, malonic acid, oxydiacetic acid, oxydisuccinic acid, succinic acid, sulfamic acid, tartaric acid, tartaric-disuccinic acid, tartaric-monosuccinic acid, or mixtures thereof. In some aspects, the organic acid is selected from the group consisting of lactic acid, acetic acid, citric acid, and mixtures thereof. In some aspects, the organic acid is citric acid. In some aspects, the composition comprises organic acids that can also serve as detergent builders, such as citric acid.

The organic acid may be a water-soluble or water-miscible acid. In some aspects, the organic acid has a solubility in water at 20° C. of at least about 10 g acid/100 ml water, or at least about 30 g acid/100 ml water, or at least about 50 g acid/100 ml water, or at least about 70 g acid/100 ml water, or at least about 85 g/100 ml water. In some aspects, the composition is substantially free of fatty acid.

The organic acid may be a low-weight acid, for example, an acid having a molecular weight of less than 210 g/mole. In some aspects, the organic acid has no more than nine carbon atoms, alternatively no more than six carbon atoms. The organic acid in the detergent composition may have no more than four carbon atoms, or no more than three carbon atoms, or fewer than three carbon atoms. Specific examples of organic acids having fewer than three carbon atoms include formic acid and acetic acid.

In some aspects, the compositions of the present disclosure comprise from about 5% to about 15%, or from about 6% to about 12%, or from about 6% to about 10%, or from about 7% to about 8.5%, by weight of the composition, of the organic acid.

Thickening Agents

Desirable viscosities in the present compositions are generally obtained through the careful selection of surfactants rather than through the addition of thickening agents. In some aspects, therefore, the compositions described herein are substantially free of thickening agents. In other aspects, the compositions comprise thickening agents to further build viscosity. Therefore, in some aspects, the composition comprises from about 0.01% to about 1%, or from about 0.02% to about 0.75%, or from about 0.05% to about 0.5%, by weight of the composition, of a thickening agent.

Thickening agents include methylcellulose, hydroxypropylmethylcellulose, xanthan gum, gellan gum, guar gum and hydroxypropyl guar gum, succinoglycan, and trihydroxystearin. Other thickening agents include methylcellulose and hydroxypropylmethylcellulose thickeners available under the Methocel® trade name from Dow Chemical and Alcogum L520 from Akzo Nobel. For the removal of doubt, as used herein, "thickening agent" does not include detersive surfactants or their salts.

Thickening agents also includes certain salts, such as sodium chloride or sodium formate. In low pH formulations, however, salts may be particularly undesirable, as salts may contribute to corrosion and stability issues. In some aspects, therefore, the compositions of the present disclosure are substantially free of alkali metal halides, alkali earth metal halides, or mixtures thereof. In some aspects, no alkali metal halides or alkali earth metal halides are added to the compositions as free components. In some aspects, the compositions are substantially free of sodium chloride and/or sodium formate. In some aspects, the compositions are substantially free of chloride ion and/or formate ion. In some aspects, the compositions are substantially free of formic acid. The compositions may comprise less than about 0.5%, or less than about 0.1%, or less than about 0.01%, by weight of the composition, of sodium chloride, or of halide ions, or of chloride ions.

pH

The compositions described herein are low pH detergent compositions. By "low pH," it is meant that the compositions have a neat pH of less than about 7, or, in some aspects, of less than about 6.5. In some aspects, the compositions have a neat pH of from about 1.5 to about 6.9, or from about 1.5 to about 6.5, or from about 1.5 to about 6, or from about 2 to about 5, or from about 2 to about 4, or from about 2 to about 3, or about 2.5.

In some aspects, a neutralizing (or alkalizing) agent is added to the composition in order to obtain the desired final neat pH of the composition. Suitable neutralizing agents include alkaline metal, alkaline earth metal or substituted ammonium hydroxide, carbonate, bicarbonate, silicate, or mixtures thereof. Alternatively, the neutralizing agent may be an amine or amide. In some aspects, the neutralizing agent is an alkanolamine selected from monoethanolamine (MEA), diethanolamine, triethanolamine, 2-aminopropanol, monoisopropanol amine (MIPA), or mixtures thereof. In some aspects, the alkalizing agent is NaOH, MEA, or mixtures thereof. In some aspects, the composition comprises less than about 1%, or less than about 0.5%, or less than about 0.1%, by weight of the composition, alkanolamine. In some aspects, the composition comprises less than about 0.5% ethanolamine.

In some aspects, the detergent compositions of the present disclosure are capable of delivering a pH to the wash water ("wash water pH"), for example of a standard laundry bucket, of less than about 6.5, or less than about 6.2, or less than about 6.0. In practical terms, the detergent compositions of the present invention are provided to the wash water in a sufficient amount such that the wash water contains from about 0.02% to about 4%, by weight of the wash water, of the detergent composition. In one aspect, the wash water contains from about 0.03% to about 3%, by weight of the wash water, of the detergent, alternatively from about 0.04% to about 2% (about 400 to about 20,000 ppm).

Reserve Acidity

As used herein, "reserve acidity" refers to the grams of NaOH per 100 g of product required to attain a pH of 7.00. The reserve acidity measurement as used herein is based upon titration (at standard temperature and pressure) of a 1% product solution in distilled water to an end point of pH 7.00, using standardized NaOH solution. Without being limited by theory, the reserve acidity measurement is found to be the best measure of the acidifying power of a composition, or the ability of a composition to provide a target acidic wash pH when added at high dilution into tap water, as opposed to pure or distilled water. The reserve acidity is controlled by the level of formulated organic acid along with the neat product pH.

The compositions described herein have a reserve acidity of at least about 1, or at least about 3, or at least about 5. In some aspects, the compositions herein have a reserve acidity to pH 7.00 of from about 3 to about 10, or from about 4 to about 7.

Viscosity

In some aspects, the compositions have viscosities greater than about 200 cps (centipoise) measured at 20 $s^{-1}$ at 21.1° C. In some aspects, the compositions have viscosities from about 200 cps to about 3000, or from about 200 to about 1500 cps, or from about 200 cps to about 1200 cps, or from about 200 cps to about 850 cps, or from about 250 cps to about 700 cps, or from about 200 cps to about 400 cps, measured at 20 $s^{-1}$ at 21.1° C.

In these definitions and unless specifically indicated to the contrary, all viscosities stated herein are measured at a shear rate of 20 $s^{-1}$ and at a temperature of 21.1° C. Viscosities can be measured with any suitable viscosity-measuring instrument, e.g., LVDVII+ or RVDVII+ Brookfield instruments.

Stability

Generally, the compositions described herein are physically stable, meaning that the compositions do not significantly phase separate. In order to test a composition for stability/phase separation, the composition is loaded into 10 mL vials and kept at 10° C., 25° C., and 40° C. for seven days. After seven days at each of the various temperatures, the vials are examined for phase separation. A composition is determined to be phase stable at a particular temperature if (i) the composition remains free from splitting into two or more layers or (ii) it splits into layers but the major layer comprises at least 90% or at least 95% of the composition by weight.

Laundry Adjuncts

The compositions of the present invention may comprise one or more laundry adjuncts, such as dyes, bleaching agents, chelants, radical scavengers, perfumes, fluorescent whitening agents, suds supressors, soil suspension polymers, soil release polymers, dye-transfer inhibitors, fabric softening additives, structurant, builders, enzymes, preservatives, solvents, clay soil removal/anti-redeposition agents, and/or other benefit agents. In some aspects, the composition may comprise from about 0.01% to about 50% of an adjunct listed herein. In other aspects, the composition may be substantially free of adjuncts. Suitable laundry adjuncts are further described, for example, in U.S. patent application Ser. No. 13/623,128, incorporated herein by reference.

Dyes

The compositions may comprise a dye to either provide a particular color to the composition itself (non-fabric substantive dyes) or to provide a hue to the fabric (hueing dyes). In one aspect, the compositions of the present invention comprise from about 0.0001% to about 0.01%, by weight of the composition, of a non-fabric substantive dye and/or a hueing dye. Examples of dyes useful herein include Basic Violet 3 (Cl 42555) and Basic Violet 4 (Cl 42600), both commercially available from Standard Dyes (High Point, N.C.), and Liquitint Violet 200 from Milliken Company.

Bleaching Agent

The compositions may comprise a bleaching agent. In some aspects, the compositions of the present invention may contain from about 0.10% to about 10%, by weight of the composition, of a bleaching agent. Bleaching agents useful herein include hydrogen peroxide or peroxyacids, such as 6-phthalimidoperoxyhexanoic acid. In some aspects, the compositions may comprise a bleach activator, such as TAED or NOBS. When the composition is in a unit dose form having at least two, or at least three, compartments, the bleaching agent may be in a different compartment than the surfactant. In some aspects, the compositions are substantially free of bleaching agents.

Chelants

The compositions may comprise a chelant. Chelants useful herein include DTPA, HEDP, DTPMP, polyfunctionally-substituted aromatic chelants (such as 1,2-dihydroxy-3,5-disulfobenzene (Tiron)), dipicolinic acid, and mixtures thereof.

Radical Scavenger

The compositions may comprise a radical scavenger which may be used with liquid hydrogen peroxide to provide stability. Radical scavengers useful herein include trimethoxybenzoic acid.

Perfumes

The compositions of the present invention may comprise perfume. The perfume is typically an acid-stable perfume. The compositions may comprise from about 0.1% to about 5%, or from about 0.5% to about 4%, or from about 1% to about 3%, or from about 2% to about 2.5%, by weight of the composition, of perfume.

In some aspects, the compositions disclosed herein may comprise a perfume delivery system. Suitable perfume delivery systems, methods of making certain perfume delivery systems, and the uses of such perfume delivery systems are disclosed in USPA 2007/0275866 A1. Such perfume delivery system may be a perfume microcapsule. The perfume microcapsule may comprise a core that comprises perfume and a shell, with the shell encapsulating the core. The shell may comprise a material selected from the group consisting of aminoplast copolymer, an acrylic, an acrylate, and mixtures thereof. The aminoplast copolymer may be melamine-formaldehyde, urea-formaldehyde, cross-linked melamine formaldehyde, or mixtures thereof. The perfume microcapsule's shell may be coated with one or more materials, such as a polymer, that aids in the deposition and/or retention of the perfume microcapsule on the site that is treated with the composition disclosed herein. The polymer may be a cationic polymer selected from the group consisting of polysaccharides, cationically modified starch, cationically modified guar, polysiloxanes, poly diallyl dimethyl ammonium halides, copolymers of poly diallyl dimethyl ammonium chloride and vinyl pyrrolidone, acrylamides, imidazoles, imidazolinium halides, imidazolium halides, poly vinyl amine, copolymers of poly vinyl amine and N-vinyl formamide, and mixtures thereof. The perfume microcapsule may be friable and/or have a mean particle size of from about 10 microns to about 500 microns or from about 20 microns to about 200 microns. In some aspects, the composition comprises, based on total composition weight, from about 0.01% to about 80%, or from about 0.1% to about 50%, or from about 1.0% to about 25%, or from about 1.0% to about 10% of perfume microcapsules. Suitable capsules may be obtained from Appleton Papers Inc., of Appleton, Wis. USA. Formaldehyde scavengers may also be used in or with such perfume microcapsules.

Fluorescent Whitening Agent

The compositions may comprise a fluorescent whitening agent. Fluorescent whitening agents useful herein include those that are compatible with an acidic environment, such as Tinopal CBS-X.

Suds Supressor

The compositions may comprise suds suppressor. In some aspects, the compositions comprise from about 0.001% to about 0.02%, by weight of the composition, of suds suppressor. Examples of suds suppressors useful herein include silica/silicone type, silicone oil, branched alcohols, or mixtures thereof.

Soil Suspension Polymers

The compositions may comprise from about 0.001% to about 0.5% by weight of the composition of soil suspension polymers. Soil suspension polymers include, without limitation, PEI ethoxylates, HMDA diquat ethoxylates, sulfonated derivatives, and hydrophobically modified anionic copolymers.

Soil Release Polymers

The compositions may comprise from about 0.001% to about 0.5% by weight of the composition of soil release polymers. Soil release polymers include, without limitation, a PET alkoxylate short block copolymer, an anionic derivative thereof, or mixtures thereof.

Dye Transfer Inhibitors

The compositions may comprise dye transfer inhibitors and/or dye fixatives. Examples of dye transfer inhibitors useful herein include polyvinylpyrrolidone, poly-4-vinylpyridine-N-oxide, copolymers of N-vinyl-2-pyrrolidone and N-vinylimidazole, or mixtures thereof. Useful dye fixatives for this application are disclosed in U.S. Pat. No. 6,753,307.

Fabric Softening Additives

The compositions may comprise a fabric softening additive. Examples of fabric softening additives useful herein include alkyl quaternary ammonium compounds, ester quaternary ammonium compounds, silicones, cationic silicones, or mixtures thereof.

Structurant

The compositions of the present invention typically rely on internal structuring rather than external structuring. By "internal structuring," it is meant that the detergent surfactants are relied on for structuring effect. On the other hand, "external structuring" means structuring that relies on a non-surfactant, e.g., crystallized glyceride(s), as structurants to achieve the desired rheology and particle suspending power.

In some aspects, the compositions of the present invention are substantially free of external structuring systems. In some aspects, the compositions are substantially free of hydroxyfunctional crystalline materials, including but not limited to hydrogenated castor oil (HCO). In some aspects, the compositions comprise less than about 0.01%, or less than about 0.001%, by weight of the composition, of hydroxyfunctional crystalline materials, or of hydrogenated castor oil. In other aspects, where additional structuring is desired, the compositions may comprise from about 0.01% to about 6%, by weight of the compositions, of hydroxyfunctional crystalline materials.

Enzymes

The compositions may comprise from about 0.00001% to about 0.01% active enzymes that are stable and effective in a low-pH environment. Suitable enzymes include carbohydrase, amylase, cellulase, lipase, protease, or mixtures thereof.

Builders

The composition may comprise a builder. Suitable builders herein can be selected from the group consisting of phosphates and polyphosphates, especially the sodium salts; aluminosilicates and silicates; carbonates, bicarbonates, sesquicarbonates and carbonate minerals other than sodium carbonate or sesquicarbonate; organic mono-, di-, tri-, and tetracarboxylates especially water-soluble nonsurfactant carboxylates in acid, sodium, potassium or alkanolammonium salt form, as well as oligomeric or water-soluble low molecular weight polymer carboxylates including aliphatic and aromatic types; and phytic acid. These may be complemented by borates, e.g., for pH-buffering purposes, or by sulfates, especially sodium sulfate and any other fillers or carriers which may be important to the engineering of stable surfactant and/or builder-containing detergent compositions.

Preservatives

The compositions may comprise a preservative. Suitable preservatives may be selected by one of ordinary skill in the art and may include Proxel™ (available from Arch Chemicals/Lonza). The composition may comprise from about 0.01% to about 2.0%, or about 0.1% to about 1.0%, or about 0.1% to about 0.3%, by weight of the composition, of preservative. In some aspects, the compositions comprise less than 0.01% of a preservative. In some aspects, the compositions are substantially free of preservatives.

Solvents

In some aspects, the composition comprises water and is substantially free of organic solvent. In other aspects, the composition may comprise organic solvent. Preferred organic solvents include 1,2-propanediol, ethanol, glycerol, dipropylene glycol, methyl propane diol and mixtures thereof. Other lower alcohols, such C1-C4 alkanolamines, e.g. monoethanolamine and/or triethanolamine, can also be used.

In some aspects, the compositions comprise from about 0.05% to about 25%, or from about 0.1% to about 15%, or from about 1% to about 10%, or from about 2% to about 5%, by weight of the composition, organic solvent. In some aspects, the composition comprises less than 5% or less than 1% of organic solvent.

Clay Soil Removal/Anti-Redeposition Agents

The compositions may comprise clay soil removal/anti-redeposition agents, such as water-soluble ethoxylated amines. Other exemplary clay soil removal and anti-redeposition agents are described in U.S. Pat. Nos. 4,597,898; 548,744; 4,891,160; European Patent Application Nos. 111,965; 111,984; 112,592; and WO 95/32272. In some aspects, the concentrated compositions comprise about 0.005% to about 5% by weight of clay soil removal/anti-redeposition agents. In some aspects, the composition is substantially free of clay soil removal/anti-redeposition agents.

Method of Use

The present disclosure provides a method for treating a surface, for example, fabric, with the compositions disclosed herein. In some aspects, the method comprises the steps of optionally washing and/or rinsing the surface, contacting the surface with the disclosed composition, then optionally washing and/or rinsing the surface. Following the treatment of the surface with the disclosed composition, the surface may optionally be dried. The surface may be contacted with the composition in neat form or in dilute form; in some aspects, the composition may be mixed with wash water. The method for treating a surface may be performed manually, such as by hand washing, or in an automated fashion, such as by a machine, e.g., a laundry washing machine.

Examples

Non-limiting examples of compositions according to the present disclosure, as well as comparative examples, are shown below in Tables 2, 3, and 4.

Preparation of Examples

To prepare the compositions, add about 80% of the composition's water to a batch tank. Add about 80% of the composition's base (e.g., NaOH or MEA). Gently agitate. While mixing, add the acid, then the surfactants. Continue agitating until the surfactants are completely blended; while blending, the agitation may be increased. Once the surfactants are completely blended, the other adjuncts may be added (polymers, chelants, dyes, perfumes, etc.). Titrate to the desired final neat pH by adding parts of the remaining base. Balance with the remaining water.

Determining Viscosity

Viscosity measurements are performed on a model LVDV-II+ or RVDV-II+ Brookfield Viscometer (Brookfield Engineering Labs Inc, Middleboro Mass.). A standard check using appropriate Brookfield standard at 25° C. is performed 1 time per week. Measurements are taken using the Brookfield water-jacketed small sample adapter (model SC4-13R), connected to a recirculation water bath for temperature compensation, and spindle SC4-31 (entry code=31), operating at 60 RPM (for 20 $s^{-1}$ shear measurement). Temperature of the water bath is set to 21.1° C. Check to ensure the instrument is level using the bubble leveler. The instrument is turned on and auto zeroed with no spindle attached. Ensure the sample being measured is de-aerated, then load the removable sample chamber with approximately 15 mL of product, pouring the sample fluid slowly down the inside wall to avoid air bubble entrapment. Place sample chamber in small sample adapter cup and immerse the spindle into the sample fluid. Allow 30 minutes for the sample, sample chamber and spindle to reach the test temperature. Turn on the motor to appropriate RPM (60 rpm, 31 spindle=20 $s^{-1}$ shear rate). Toggle display key until viscosity cps readings are shown. Equilibrate the sample for 5 minutes with spindle motor on prior to taking final viscosity reading. Throughout the test, the guard leg is not attached.

Table 2.

Examples 1-8 in Table 2 are formulations according to the present invention.

TABLE 2

| | 1 % | 2 % | 3 % | 4 % | 5 % | 6 % | 7 % | 8 % |
|---|---|---|---|---|---|---|---|---|
| Total surf % | 19.72 | 9.45 | 17.93 | 18.92 | 8.12 | 8.12 | 12.05 | 12.77 |
| Linear alkylbenzene sulfonic acid (anionic) % | 6.8 | 2.35 | 7.12 | 7.12 | 2.35 | 2.35 | 5.09 | 4.62 |
| Na C12-14 E3.0S (anionic) % | 6.97 | | | | | | | 6.09 |
| C12,13 EO2 % (HLB = 7.47) | | | 0.25 | 1.24 | | | | |
| C12,13 EO3 % (HLB = 9.17) | 1.17 | 1.33 | | | 1.33 | 1 | 0.5 | 1.5 |
| C11,16 EO7 % (HLB = 11.82) | | | 10.56 | | 4.44 | 4.77 | 6.46 | |
| C14,15 EO7 % (HLB = 12.29) | | 5.77 | | | | | | |
| C12,14 EO7 % (HLB = 12.8) | 4.78 | | | | | | | 0.56 |
| C12,14 EO9 % (HLB = 13.86) | | | | 10.56 | | | | |
| Citric Acid % | 8.31 | 7.08 | 8.43 | 8.43 | 7.78 | 7.78 | 14 | 8.31 |
| Water | | | | To balance | | | | |
| Neat pH | | | | pH = 2.5 | | | | |
| Anionic:nonionic ratio | 2.31 | 0.33 | 0.66 | 0.60 | 0.41 | 0.41 | 0.73 | 5.20 |
| Stability | stable | stable | stable | stable | stable | stable | — | not stable |
| Viscosity (cps) | 690 | 290 | 320 | 1000 | 480 | 300 | — | 290 |

Measuring pH

The pH of the compositions is measured using a sympHony SP70P pH meter (VWR of Radnor, Pa.). The pH meter is calibrated according to the VWR sympHony Meter User Guide using calibration solutions of pH=4, 7, and 10, respectively. Once the pH meter is calibrated, the probe is rinsed with deionized water, placed in the neat liquid, and the value is recorded.

Table 3.

Examples 9-16 in Table 3 are formulations according to the present invention. Example 17 is a comparative example comprising two nonionic surfactants that are not selected in accordance with the present invention (e.g., both nonionic surfactants have HLB values above 10). The viscosity of Example 17 is less than the viscosities of compositions according to the present invention.

TABLE 3

| | 9 % | 10 % | 11 % | 12 % | 13 % | 14 % | 15 % | 16 % | 17 (comp) % |
|---|---|---|---|---|---|---|---|---|---|
| Total Surfactant | 9.75 | 10.38 | 19.25 | 19.65 | 18.51 | 9.53 | 13.13 | 20.04 | 18.01 |
| Na C12-14 E3.0S (anionic) | | | | | | | | 6.97 | |
| Linear alkyl benzene sulfonic acid (anionic) | 2.35 | 2.35 | 7.12 | 7.12 | 7.12 | 2.35 | 5.09 | 6.79 | 7.12 |
| C12-14 amine oxide | | | | | | | | 0.06 | |
| C12,13 EO3 (HLB = 9.17) | 1.30 | 2.25 | | 1.64 | | 1.33 | 1.50 | 1.17 | |
| C12,13 EO2 (HLB = 7.47) | | | 1.24 | | 0.50 | | | | 0.00 |
| C12,14 EO7 (HLB = 12.8) | | | | | | 0.08 | 0.08 | 5.05 | |
| C12,14 EO9 (HLB = 13.86) | 0.33 | 2.89 | 5.61 | 0.33 | 0.33 | | | | 5.61 |
| C14,15 EO7 (HLB = 12.29) | | | | | | 5.77 | 6.46 | | |
| C11,16 EO7 (HLB = 11.82) | 5.77 | 2.89 | 5.28 | 10.56 | 10.56 | | | | 5.28 |
| Citric acid | 7.78 | 7.78 | 8.43 | 8.43 | 8.43 | 7.08 | 14.82 | 8.31 | 8.43 |
| Polymer* | 0.15 | 0.15 | 1.00 | 1.00 | 1.00 | 0.50 | 0.50 | 0.46 | 1.00 |
| DTPA | 0.39 | 0.39 | 0.30 | 0.30 | 0.30 | | | 0.19 | 0.30 |
| DTPMP | | | | | | 0.14 | 0.14 | | |
| Fluorescent whitening agent | 0.07 | 0.07 | 0.12 | 0.12 | 0.12 | | | 0.06 | 0.12 |
| Propylene glycol | 0.33 | 0.33 | 0.56 | 0.56 | 0.56 | 0.26 | 0.26 | 0.36 | 0.56 |
| Ethanol | | | | | | 0.50 | 0.50 | | |
| NaOH | 0.71 | 0.64 | 2.15 | 2.15 | 2.15 | 0.67 | 1.37 | 1.66 | 2.15 |
| Dye | | | | | | 0.03 | 0.03 | | |
| Structurant (HCO) | | | | | | 0.20 | 0.20 | | |
| Opacifier | | | | | | 0.09 | 0.09 | | |
| H2O | | | | | To balance | | | | |
| Neat pH | 2.52 | 2.50 | 2.50 | 2.50 | 2.50 | 2.65 | 2.46 | 2.48 | 2.50 |
| Viscosity in cps (20 $s^{-1}$ at 21.1° C.) | 345 | 284 | 476 | 960 | 462 | 451 | 234 | 588 | 107 |

*Trans-sulphated ethoxylated hexamethylene diamine quat (available from BASF, Ludwigshafen, Germany)

Table 4.

Examples 18-20 in Table 4 are comparative examples.

TABLE 4

| | 18 (comp) % | 19 (comp) % | 20 (comp) % |
|---|---|---|---|
| Total Surfactant | 18.18 | 9.26 | 18.01 |
| Na C12-14 E3.0S (anionic) | | | |
| Linear alkyl benzene sulfonic acid (anionic) | 7.12 | 7.12 | 7.12 |
| C12-14 amine oxide | | | |
| C12,13 EO3 (HLB = 9.17) | 10.56 | 1.64 | |
| C12,13 EO2 (HLB = 7.47) | | | |
| C12,14 EO7 (HLB = 12.8) | | | |
| C12,14 EO9 (HLB = 13.86) | 0.50 | 0.50 | 0.33 |

TABLE 4-continued

| | 18 (comp) % | 19 (comp) % | 20 (comp) % |
|---|---|---|---|
| C14,15 EO7 (HLB = 12.29) | | | |
| C11,16 EO7 (HLB = 11.82) | | | 10.56 |
| Citric acid | 8.43 | 8.43 | 8.43 |
| Polymer * | 1.00 | 1.00 | 1.00 |
| DTPA | 0.30 | 0.30 | 0.30 |
| Fluorescent whitening agent | 0.12 | 0.12 | 0.12 |
| Propylene glycol | 1.52 | 1.52 | 0.56 |
| Ethanol | | | |
| NaOH | 0.80 | 0.80 | 2.15 |
| MEA | 2.24 | 2.24 | |
| H2O | | To balance | |
| Neat pH | 2.5 | 2.5 | 2.5 |
| Stability | Not stable | Not stable | |
| Viscosity in cps (20 $s^{-1}$ at 21.1° C.) | | | 186 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular aspects of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid laundry detergent composition comprising:

from about 9% to about 20% by weight of the composition of a surfactant system, wherein the surfactant system comprises a first nonionic surfactant (A), wherein A has a HLB less than 10, wherein A is selected from the group consisting of: C12,13 EO2; C12,13 EO3; and mixtures thereof;

a second nonionic surfactant (B), wherein B has a HLB greater than 10, wherein B is selected from the group consisting of: C11,16 EO7; C14,15 EO7; C12,14 EO7; C12,14 EO9; and mixtures thereof;

wherein the weight ratio of A:B is from about 1:100 to about 40:100; and from about 2% to about 15%, by weight of the composition, of anionic surfactant, wherein the anionic surfactant comprises linear alkyl benzene sulfonic acid and/or salts thereof;

wherein the composition has a neat pH of from about 1.5 to about 6.9;

wherein the composition has a viscosity of from about 200 cps to about 3000 cps measured at 20 $s^{-1}$ at 21.1° C.;

wherein the composition further comprises from about 5% to about 15%, by weight of the composition, of an organic acid, wherein the organic acid comprises citric acid.

2. A composition according to claim 1, wherein the weight ratio of A:B is from about 15:100 to about 25:100.

3. A composition according to claim 1, wherein the composition has a neat pH of from about 2 to about 4.

4. A composition according to claim 1, wherein the composition has a viscosity of from about 200 cps to about 1500 cps measured at 20 $s^{-1}$ at 21.1° C.

5. A composition according to claim 1, wherein the composition further comprises an organic solvent.

6. A composition according to claim 1, wherein the organic acid comprises no more than six carbons.

7. A composition according to claim 1, wherein the organic acid further comprises lactic acid, acetic acid, or mixtures thereof.

8. A composition according to claim 1, wherein the composition comprises less than 0.5%, by weight of the composition, of halide ions.

9. A composition according to claim 1, wherein the composition comprises less than about 1%, by weight of the composition, of alkanolamine.

10. A composition according to claim 1, wherein the composition comprises at least about 60% water.

11. A composition according to claim 1, wherein the ratio of anionic surfactant to nonionic surfactant is from about 1:100 to about 1:1.

12. A composition according to claim 11, wherein the ratio of anionic surfactant to nonionic surfactant is from about 40:100 to about 75:100.

13. A method for treating a surface, comprising the step of contacting the surface with the composition of claim 1.

14. A liquid laundry detergent composition comprising:

from about 2% to about 20% by weight of the composition of a surfactant system, wherein the surfactant system comprises a first nonionic surfactant (A), wherein A has an HLB less than 10, wherein A is selected from the group consisting of: C12,13 EO2; C12,13 EO3; and mixtures thereof;

a second nonionic surfactant (B), wherein B has an HLB greater than 10, wherein B is selected from the group consisting of: C11,16 EO7; C14,15 EO7; C12,14 EO7; C12,14 EO9; and mixtures thereof;

wherein the weight ratio of A:B is from about 1:100 to about 40:100; and from about 2% to about 15%, by weight of the composition, of anionic surfactant, wherein the anionic surfactant comprises linear alkyl benzene sulfonic acid and/or salts thereof;

from about 5% to about 15%, by weight of the composition, of organic acid, wherein the organic acid comprises no more than 6 carbon atoms, and wherein the organic acid comprises citric acid;

from about 60% to about 90% water;

wherein the composition has a neat pH of from about 2 to about 4;

and wherein the composition has a viscosity of from about 200 cps to about 1200 cps measured at 20 $s^{-1}$ at 21.1° C.

15. A composition according to claim 1, wherein the composition is substantially free of bleach, meaning that bleach has not been deliberately added to the composition.

16. A composition according to claim 1, wherein the surfactant system consists of two nonionic surfactants and one anionic surfactant.

* * * * *